United States Patent [19]

Fournier

[11] Patent Number: 4,806,043

[45] Date of Patent: Feb. 21, 1989

[54] METHOD AND DEVICE FOR DRAINAGE OF BORDERS OF ALL STABILIZED CIVIL ENGINEERING AREAS OR OF ADJACENT BORDERS OF A STRUCTURE

[75] Inventor: Christian Fournier, Moissy-Cramayel, France

[73] Assignee: Fournier Drainage S.A., Moissy-Cramayel, France

[21] Appl. No.: 103,746

[22] Filed: Oct. 1, 1987

[30] Foreign Application Priority Data

Nov. 10, 1986 [FR] France ..... 86 15633

[51] Int. Cl.[4] ..... E01F 5/00

[52] U.S. Cl. ..... 404/2; 404/3; 404/73; 404/75; 404/82; 404/107; 405/38; 405/50; 405/176; 405/179; 210/170; 210/747; 425/59; 425/62

[58] Field of Search ..... 404/2, 3, 73–75, 404/81, 82, 87, 88, 96, 107; 405/38, 50, 176, 179; 210/170, 747; 425/59, 62

[56] References Cited

U.S. PATENT DOCUMENTS

| | | | |
|---|---|---|---|
| 3,441,140 | 4/1969 | Thurber | 210/170 |
| 3,664,137 | 5/1972 | Lett | 405/50 |
| 4,028,902 | 6/1977 | Courson et al. | 405/179 X |
| 4,332,511 | 6/1982 | Bradley et al. | 405/179 X |
| 4,379,655 | 4/1983 | Brost et al. | 405/176 |
| 4,636,112 | 1/1987 | Raviv | 405/38 X |

FOREIGN PATENT DOCUMENTS

| | | | |
|---|---|---|---|
| 0023871 | 2/1981 | European Pat. Off. . | |
| 0027150 | 4/1981 | European Pat. Off. . | |
| 0075993 | 4/1983 | European Pat. Off. . | |
| 2027724 | 12/1971 | Fed. Rep. of Germany . | |
| 1399392 | 4/1965 | France . | |
| 2328800 | 5/1977 | France . | |
| 2462518 | 2/1981 | France . | |
| 0052421 | 4/1980 | Japan | 405/50 |
| 2055440 | 3/1981 | United Kingdom . | |
| 2166632 | 5/1986 | United Kingdom | 405/50 |

*Primary Examiner*—Stephen J. Novosad
*Assistant Examiner*—John F. Letchford
*Attorney, Agent, or Firm*—Young & Thompson

[57] ABSTRACT

A vertical drainage element is constructed and laid in position while at the same time forming a narrow vertical channel in the ground by means of an excavating machine or trencher by performing the following successive operations:

a strip of filtering material is unwound from a rotating roll of strip behind the trencher;

the strip is introdued within the channel formed in the ground while being shaped in the form of a trough, the bottom of the trough being placed at the bottom of the channel while the side walls of the trough are placed against the channel walls;

the top edges of the trough are held in position one against the other while filling the trough with bulk material in granular form which subsequently constitutes a vertical filtration block;

the top edges of the trough of filtering material are closed on top of the completed block and are fastened together so as to form a closed jacket around the block.

12 Claims, 5 Drawing Sheets

FIG. 4
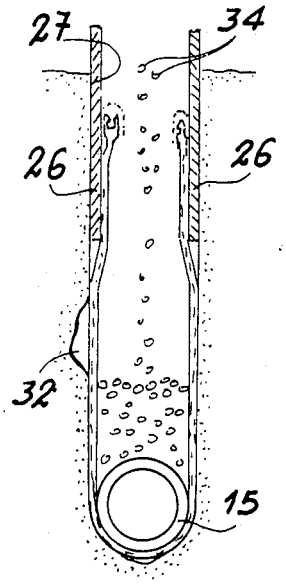
FIG. 5
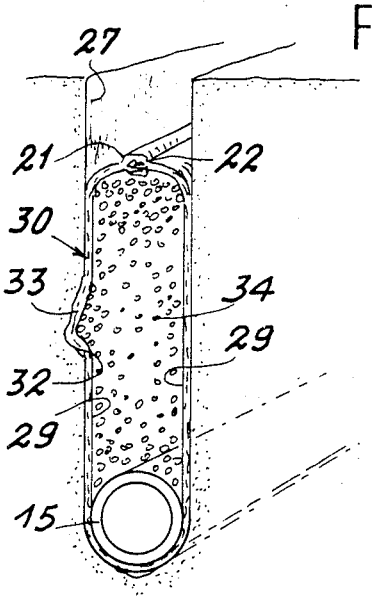
FIG. 7
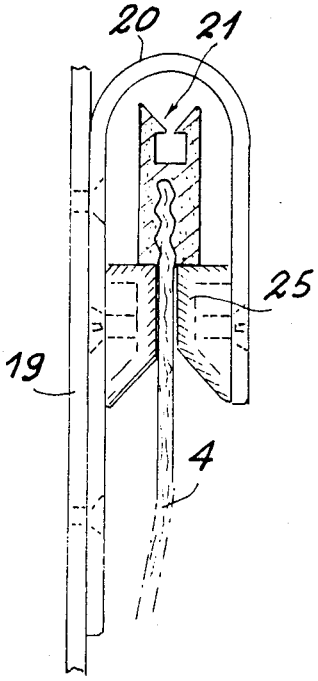
FIG. 8
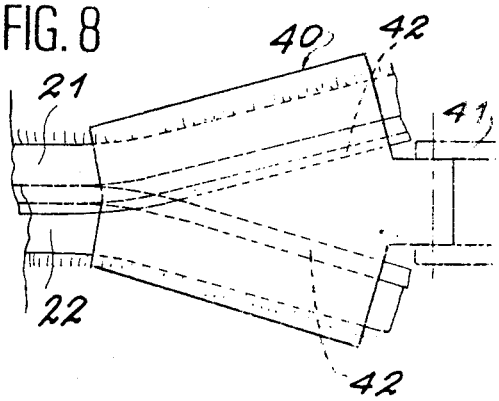
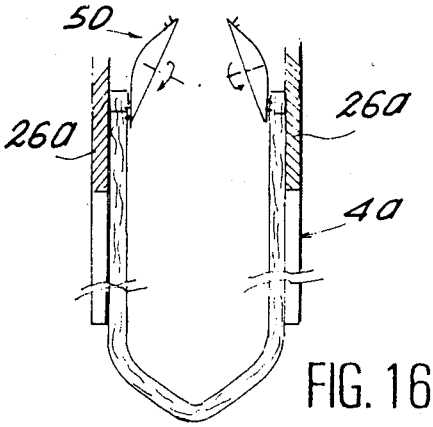
FIG. 16

FIG 9
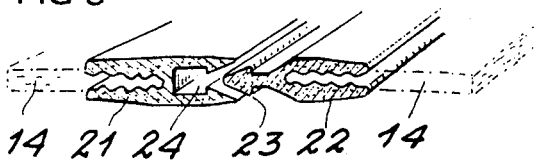
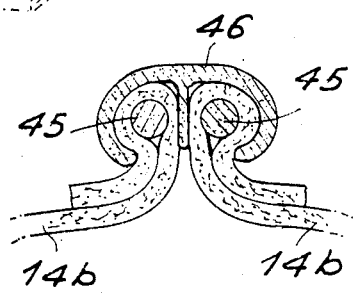
FIG. 11
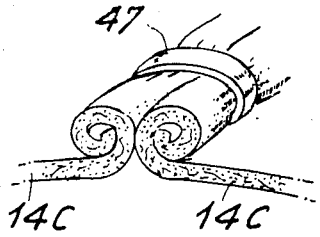
FIG. 12
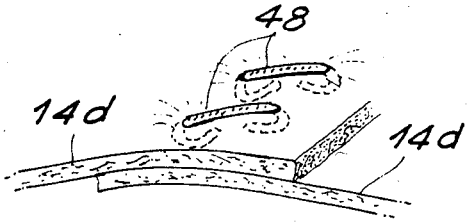
FIG. 13
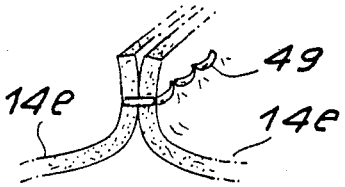
FIG. 14
FIG. 10
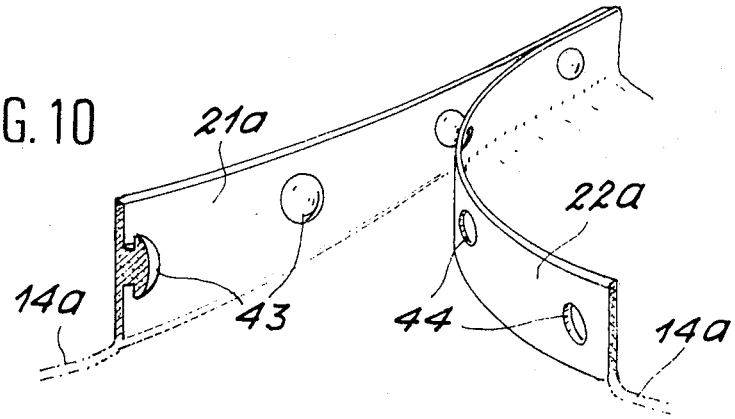

METHOD AND DEVICE FOR DRAINAGE OF BORDERS OF ALL STABILIZED CIVIL ENGINEERING AREAS OR OF ADJACENT BORDERS OF A STRUCTURE

BACKGROUND OF THE INVENTION

1. Field of the Invention

The present invention relates to drainage of borders of stabilized civil engineering areas such as roads, airfield runways and railroad tracks, for example, and further relates to drainage of adjacent borders of any structure.

2. Description of the Prior Art

In regard to roads and highways, drainage has always been necessary and is probably even more necessary at the present time on account of rising trends in traffic density as well as in weight of vehicles and also by reason of the periods of exceptional frost which have been observed during recent years. In point of fact, the water content of roads and highways is a determining factor in the stability of road surfaces.

At the present time, the most elaborate technique for draining the sides of a roadway or other stabilized area consists in forming in the ground a narrow trench 15 to 20 cm in width in which is introduced a complex vertical drainage element composed of a water-tight core having a plurality of wavy corrugations or other forms of surface relief, and of an outer jacket of filtering material, the bottom portion of which carries the drainage pipe or water-outflow duct. Thus European patent Application No. 75,993 and French Pat. No. 2,462,518 both describe complex drainage elements of this type which are intended to be used for this purpose.

However, this drainage technique is subject to a certain number of disadvantages. In the first place, it is necessary to dig a trench having a width which is greater than that of the drainage element to be placed in position. This is in fact an essential condition for laying the element by reason of its limited flexibility. In consequence, the excavating and earthmoving operations which have to be performed are as extensive as those required for conventional drainage systems which provide for simple backfilling with filtering materials. Moreover, digging of a trench also results in lateral decompaction of the roadway. Finally, after positioning of the vertical drainage element thus provided, it is necessary to backfill the trench either partially with previously extracted materials or with additional materials which preferably have a filtering function.

A further disadvantage lies in the fact that the complex drainage element thus provided is not capable of complying with the surface irregularities of the trench wall against which it is applied. There consequently remain free spaces produced by inevitable breakaway of certain soil elements during excavation of the corresponding trench. However, the existence of such free spaces is clearly liable to affect the stability of the adjacent roadway.

Yet another drawback of the technique discussed in the foregoing lies in the fact that the majority of complex drainage elements in accordance with this design and arrangement are not provided with a bottom drainage pipe.

Finally, the use of these complex drainage elements proves very costly by reason of a certain number of factors including in particular the mode of manufacture involved by reason of their basic design, the high cost of raw materials employed, the cost of transport of such elements to their place of use and the cost of positioning of these elements.

In regard to the last-mentioned point, it should be borne in mind that the technique under consideration involves the performance of three successive operations: first of all, the formation of a trench of relatively substantial width, then the positioning of the complex drainage element provided and finally backfilling of that portion of the width of the trench which remains free after installation of said element.

For this reason, the object of the present invention is to provide a drainage system of the type considered which is just as efficient as in the case of the technique described earlier but which is not subject to its disadvantages.

SUMMARY OF THE INVENTION

To this end, the primary object of the invention is to provide a method of drainage which essentially consists in constructing and laying a vertical drainage element while at the same time forming a narrow vertical channel in the ground by means of an excavating machine or trencher by performing the following successive operations :

a strip of filtering material is unwound from a rotating roll of strip behind the excavating machine;

the strip is introduced within the channel formed in the ground while at the same time shaping the strip in the form of a trough, the bottom of the trough being placed at the bottom of the channel while the side walls of the trough are placed against the corresponding walls of said channel;

while the top edges of the trough thus formed are held in position one against the other, the trough is filled with bulk material in granular form which is capable of constituting a vertical filtration block;

the top edges of the trough of filtering material are closed on top of the block thus formed and the two edges are fastened together so as to form a closed jacket around the block.

This method accordingly makes it possible to form in situ a vertical drainage element which has the same efficiency as the prefabricated complex elements recalled earlier. In the case under consideration, however, the construction and installation of the drainage element are carried out at the same time as formation of the channel which is intended to serve as a housing for the element in the ground. This not only dispenses with any need for multiple operations but also avoids the need for extensive backfilling operations. Moreover the present method is particularly economical by virtue of its basic concept and the nature of the materials employed.

In a particular embodiment of this method, a drainage pipe is placed in position against the bottom of the trough formed by the strip of filtering material. In another embodiment, provision is made for a leak-tight lining or the like on that portion of the said strip of filtering material which is intended to constitute the bottom of the corresponding trough, thus making it possible to form a water outflow gutter.

A further object of the invention is to provide a device which is specially designed for the practical execution of this method and is intended to be hitched to the rear end of an excavating machine or trencher. To this end, the device essentially comprises in combination :

an unwinding drum for carrying a roll of continuous strip of filtering material;

a strip-laying casing placed immediately behind the work member of the machine employed for cutting a channel in the ground, the said casing being provided with guide means for constraining the strip of filtering material to move downwards within the channel formed in the ground while adopting the shape of a virtual U-section channel;

at the rear end of the said strip-laying casing, a hopper which has the function of discharging bulk material in granular form and is capable of constituting a vertical filtering block within the trough thus formed, the side walls of the lower portion of the hopper being located in the line of extension of the side walls of the strip-laying casing and being engaged at least to a partial extent within the channel formed in the ground;

within the lower portion of the hopper, means for ensuring that the top edges of the trough formed by the strip of filtering material are retained while filling of said trough is in progress;

at the rear end of the entire assembly, means for closing the top edges of the trough of filtering material as well as means for fastening the edges together in order to constitute a closed jacket around the drainage packing.

Yet another object of the invention is to provide a drainage element specially designed for the application of at least a certain number of embodiments of the method considered. This element consists of a strip of filtering material which is capable of constituting the filtering jacket of the vertical drainage packing and the edges of which are provided with beads so that the top edges of the trough formed by the strip can be retained while the trough is being filled with bulk material in granular form. In a particular embodiment, the beads aforesaid are provided with coupling means which make it possible to fasten them together by simple resilient engagement under pressure.

BRIEF DESCRIPTION OF THE DRAWINGS

FIG. 4 is a transverse sectional view along line IV—IV of FIG. 2 but on a different scale;

FIG. 5 is a transverse sectional view of the vertical drainage element constructed by means of the method in accordance with the invention;

FIG. 7 is a fragmentary vertical sectional view of a detail considered in the case of the supporting members provided for retaining the top edges of the trough formed by the strip of filtering material;

FIG. 8 is a fragmentary overhead plan view representing a system for fastening the aforesaid edges so as to form a jacket around the vertical drainage packing;

FIG. 9 is a sectional view of the coupling beads provided in such a case on the edges of the strip of filtering material;

FIG. 10 is a similar view of an alternative embodiment;

FIGS. 11 to 14 are fragmentary sectional views illustrating other modes of fastening of the edges of the jacket formed by the strip of filtering material;

FIG. 16 is a view which is similar to FIG. 4 but which illustrates another alternative embodiment.

DESCRIPTION OF THE PREFERRED EMBODIMENTS

Figure 1:
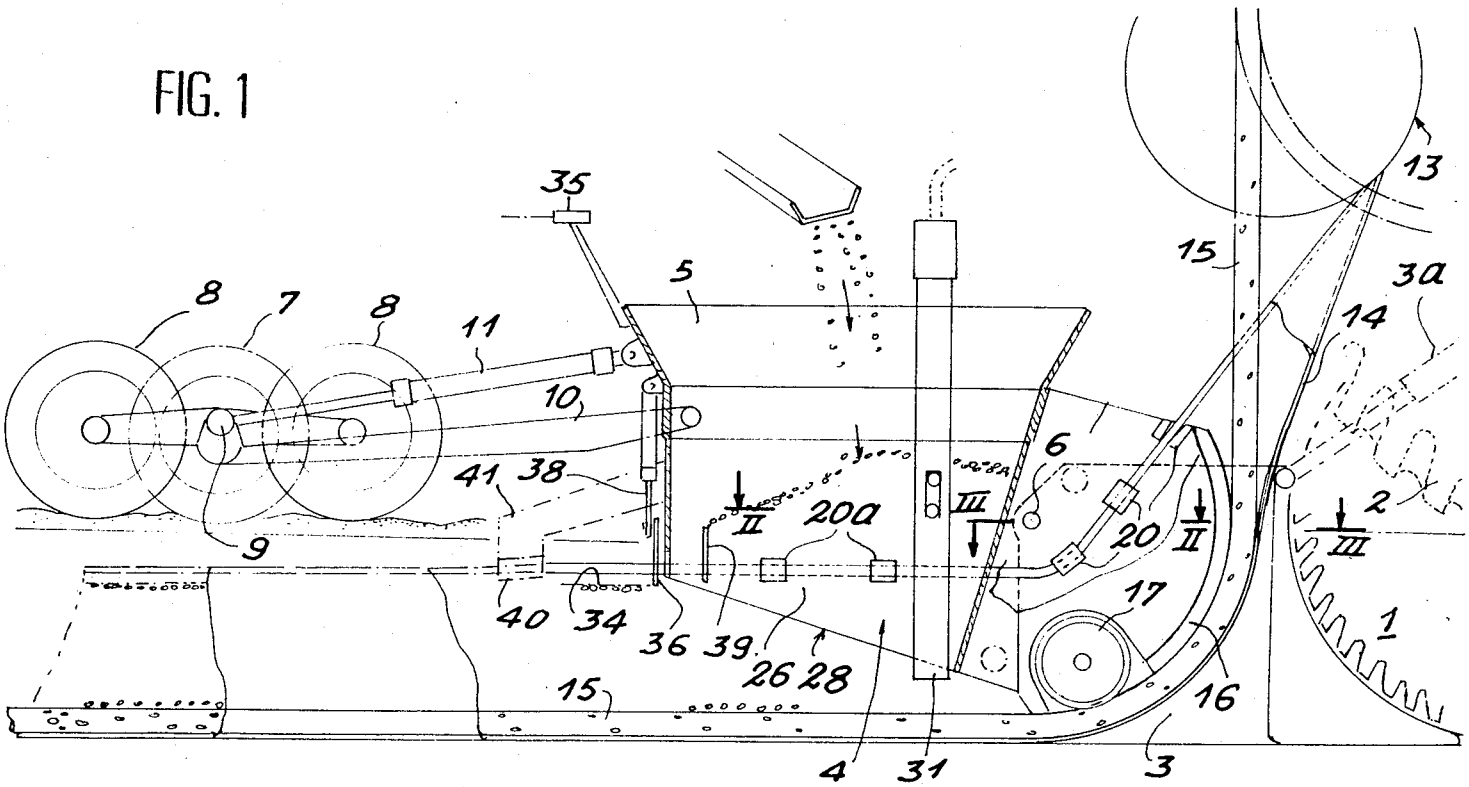
FIG. 1 is a schematic axial vertical sectional view of the device in accordance with the invention.
Figure 2:
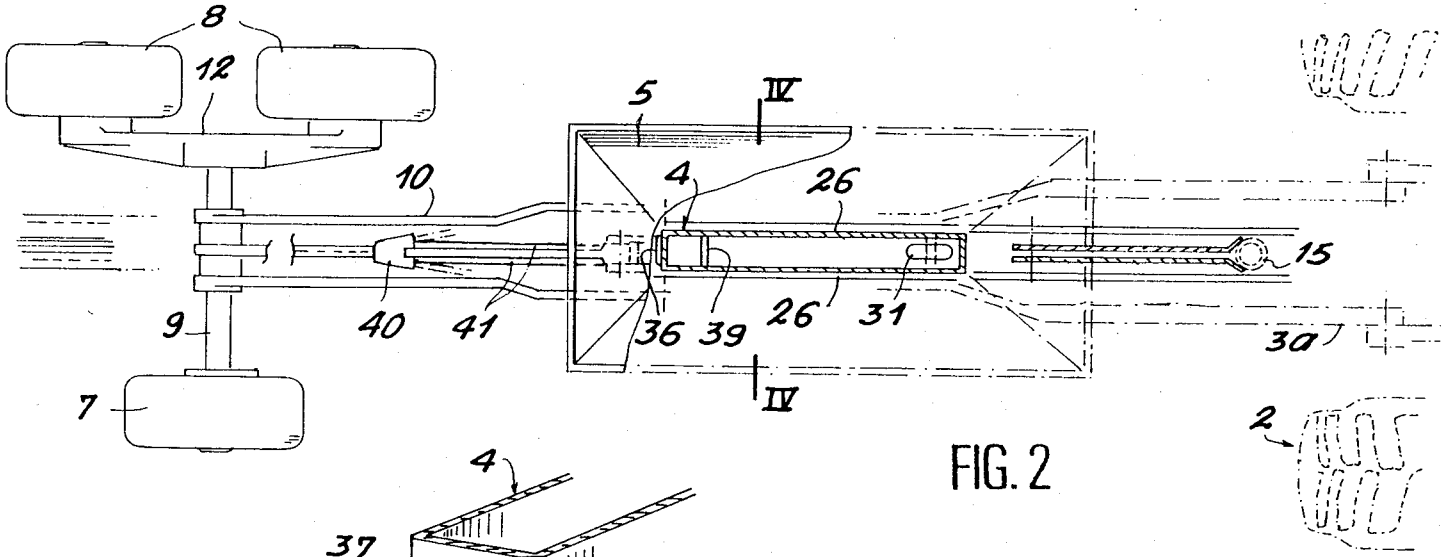
FIG. 2 is a schematic sectional view taken along line II—II of FIG. 1.
Figure 6:
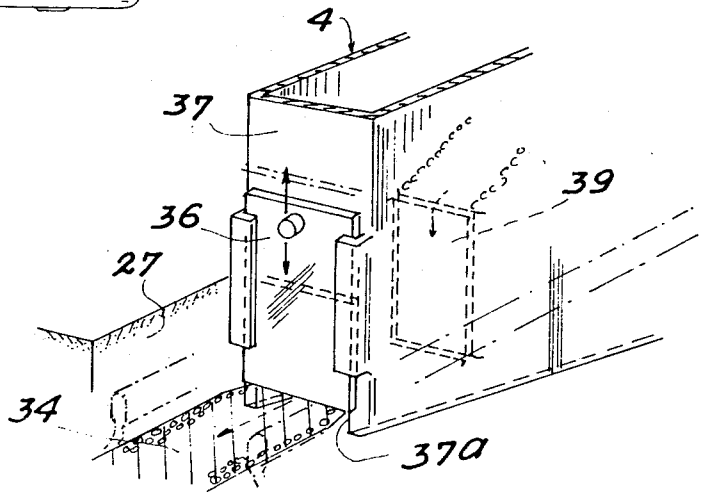
FIG. 6 is a fragmentary view in perspective showing a detail of the device considered in the case of a system provided for regulation of filling of the trough formed by the strip of filtering material.
Figure 3:
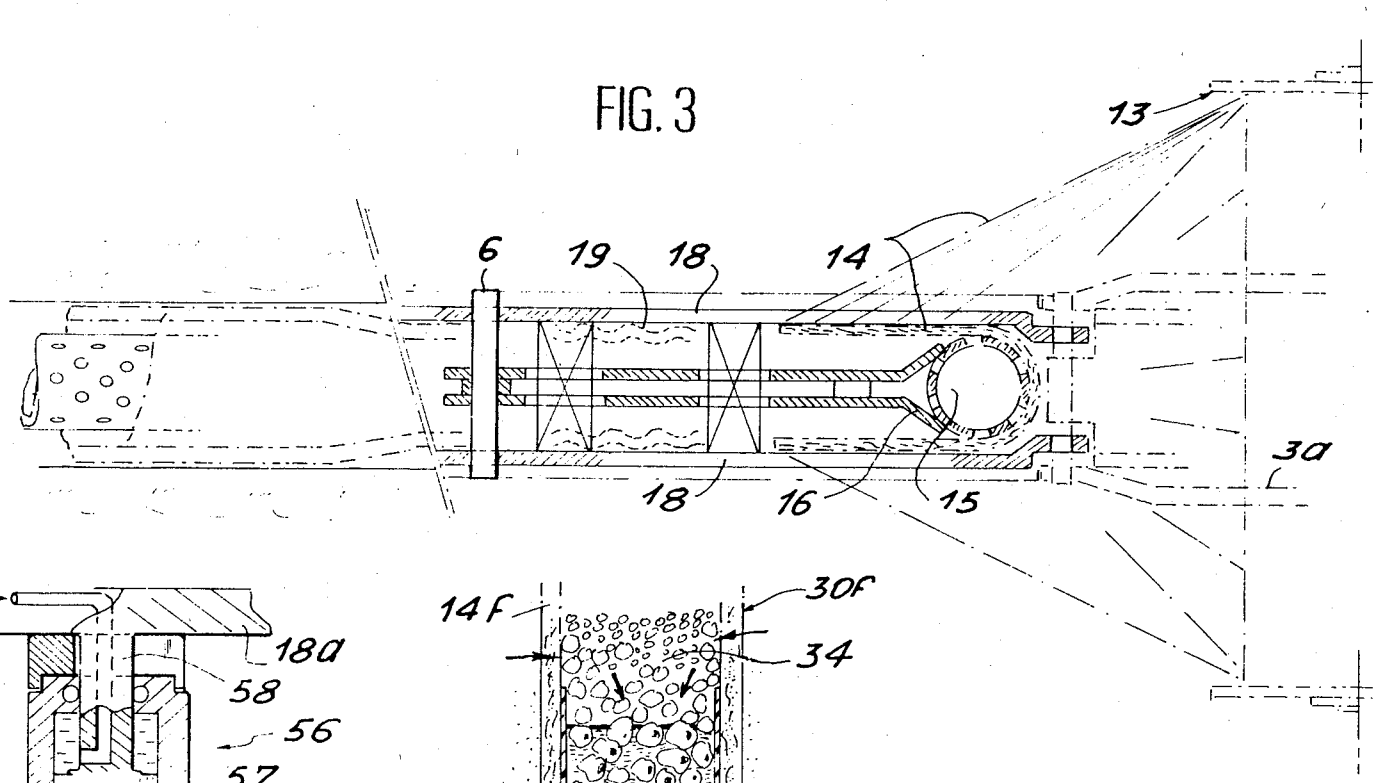
FIG. 3 is a fragmentary sectional view along the same plane but on a different scale.

For the practical application of the method in accordance with the invention, it is proposed to make use of a device as shown in the accompanying drawings by hitching this latter to the rear end of an excavating machine or trencher which is designed to form a narrow channel in the ground. This machine can be of the type comprising an excavating wheel mounted on the rear end of a self-propelled chassis. In view of the fact that machines of this type are already known, there are shown in the accompanying drawings only the excavating wheel 1 of the trencher as well as the two rear wheels 2 of the trencher chassis.

The device in accordance with the invention includes a strip-laying casing 3 which is placed immediately behind the excavating wheel 1 and replaces the shoe which is usually provided behind a wheel of this type. This hollow casing has an open top and is hitched near its rear end to the chassis of the excavating machine, for example by means of hitch link-arms 3*a*. Accordingly, as will be described hereinafter, the design function of the casing is to lay within the channel formed in the ground a strip of filtering material shaped in the form of a trough so as to constitute the jacket of the drainage element to be formed. To this end, the bottom face of the casing is located at the bottom of the trench cut.

Provision is made at the rear end of the casing for a discharge hopper 5, the intended function of which is to ensure that the trough thus formed is filled with granular materials in bulk which are capable of constituting a vertical filtering block. The side walls of the lower portion of the hopper are located in the line of extension of the corresponding walls of the casing 3 and are at least partially engaged within the channel formed in the ground. Accordingly, these walls virtually constitute a second casing 4 for positioning the complex drainage element to be constructed.

The discharge hopper 5 is pivotally mounted on the first casing 3 by means of a horizontal cross-pin 6. The hopper is supported at the rear end by a train of wheels 7 and 8. This wheel train has a transverse axle 9, one end of which carries a single wheel 7 while the other end carries two wheels 8. The connection between the hopper 5 and the axle of this wheel train is established by means of a pair of link-arms 10. However, provision is additionally made for a jack 11 which is capable of adjusting the level of the hopper 5. It is worthy of note that the two wheels 8 provided on one of the two sides are pivotally mounted on the corresponding end of the axle 9 by means of an arm 12 forming a compensating-beam which serves to guard against the effects of surface irregularities of the ground.

Above the front casing 3, provision is made for two unwinding drums which can be supported by the chassis of the excavating machine. One of these unwinding drums is adapted to carry a roll 13 formed by a coiled strip 14 of filtering material. This strip is intended to constitute the jacket of the vertical drainage element to be constructed. In regard to the second unwinding drum (not shown in the drawings), this drum is adapted to carry a roll formed by a flexible drainage pipe 15 of the type consisting of perforated ringed hose piping employed for agricultural drainage operations.

The first casing 3 contains means for receiving and guiding the strip 14 as well as the flexible pipe 15 for positioning them within the channel formed in the ground. In the example under consideration, provision is made for a curved guide channel 16 for receiving the central portion of the strip 14, the drainage pipe 15 being placed against the rear face of the strip. A bearing roller 17 then has the function of maintaining the flexible pipe against the corresponding portion of the strip 14.

By reason of the pressure thus exerted by the drainage pipe 15 against the central portion of the strip 14 when this latter penetrates into the casing 3, the strip is caused to assume virtually the shape of a U-section trough, the bottom wall of which is formed by the central portion of the strip. This particular shaping operation is performed by lifting the two lateral portions of the strip 14 and sliding these latter against the two side walls 18 of the casing 3. It will be understood that the strip is provided with pleats 19 in the area in which the strip is progressively shaped in the form of a trough by reason of the general curvature imparted thereto in the axial direction.

Preferably, the side walls 18 of the casing 3 are adapted to carry guide members 20 on their internal faces, said members being intended to guide the edges of the strip 14 during this operation. It should be noted in this connection that, in the example illustrated in FIGS. 1 to 5, the device in accordance with the invention is so designed as to be employed with a strip 14 of filtering material having edges provided with beads 21 and 22 forming overthicknesses. These beads can be formed separately on the edges of the strip 14 or directly overmolded on this latter. The strip itself is made of geotextile material of the type commonly employed for drainage.

In accordance with another arrangement shown in FIGS. 9 and 10, the beads considered in the foregoing can advantageously comprise means for coupling by simple resilient engagement. Thus, one of the beads 22 can have a rib 23 provided with an enlarged end portion while the other bead 21 has a receiving channel 24 provided with a constriction at its inlet. Coupling of these two beaded edges can thus be obtained by simple interengagement.

Taking into account the existence of these beads 21 and 22, the guide members 20 provided within the casing 3 can consist of supports 25 as shown in FIG. 7. These supports 25 can serve as guides for sliding displacement of the edges of the filtering strip 14 and are also capable of supporting the beads 21 and 22 of the edges.

As already mentioned, the side walls 26 of the second casing 4 are also engaged within the channel 27 formed in the ground. Furthermore, the spacing of these walls is the same as the spacing provided between the side walls 18 of the first casing 3. However, the bottom edges 28 of the side walls 26 of the second casing are raised, with the result that the rear end of the casing is engaged only to a slight extent within the channel 27 formed in the ground. Under these conditions, the side walls 29 of the trough 30 formed by the filtering strip 14 are moved progressively into contact with both walls of the channel 27. In consequence, when the trough is completely filled, its side walls are in direct contact with the walls of the ground channel.

Filling of the trough is carried out by discharging bulk material in granular form from the hopper 5. By way of example, the material used for this purpose can consist of gravel, porous concrete, or particles of expanded materials, and so on.

The material thus discharged into the filtering trough 30 can be compacted in various ways, for example by means of a series of mandrels applied on the top surface of the discharged material, or by means of a vibrating circular compactor, or else by means of an internal vibrator such as the vertical poker 31 shown in FIG. 1.

While filling of the filtering trough 30 is in progress, the vertical edges of this latter are retained by means provided for this purpose on the side walls 26 of the casing 4. In the example shown in the drawings, these means can consist of supporting members **20*a* which are similar to the members 20 described earlier and one of which is illustrated in FIG. 7. The supporting members designated in FIG. 4 by the reference 25 are so designed as to form guides which are capable of supporting the beads 21 or 22 provided on the top edges of the filtering strip 14. This accordingly serves to prevent collapse of the side walls of the trough 30** while filling is in progress.

In view of the fact that, during this operation, the side walls 29 of the filtering trough 30 are in direct contact with the corresponding walls of the channel 27 formed in the ground, these side walls are made to comply with the surface irregularities of the walls. Thus, as illustrated in FIG. 5, in the event that one of the walls of the channel 27 has a cavity 32, the corresponding wall 29 of the trough 30 is caused to form a boss 33 which fills the cavity under the action of the pressure of bulk material 34 which is discharged into the trough and constitutes a filtration packing or block. There are thus not allowed to remain any empty spaces which would be liable to impair the stability of the area having an edge portion or border in which the drainage system in accordance with the invention is constructed.

A system of adjustment is provided for maintaining the hopper 5 at the correct height. This system includes the jack 11 which permits lifting or lowering of the hopper 5 by pivotal displacement about the cross-pin 6. This jack is controlled by a laser receiver 35 which is capable of receiving a laser beam produced by an emitter so as to define the height to be maintained.

The level of the top surface of the filtration block 34 is regulated by means of a gate 36 which is mounted so as to be capable of sliding displacement in vertical motion against a recessed portion **37*a* of the lower end of the rear wall 37 of the casing 4. The gate is actuated by a control jack 38. At a short distance upstream of the gate, provision is made for a transverse partition 39 having the function of preventing the pressure of the mass of material contained within the hopper 5 from being exerted directly on the movable gate 36. The partition accordingly produces a first scraping action on the discharged material but regulation of the top level of the filtering block 34 is subsequently carried out by the gate 36** as a function of the position in which it is placed.

After delivery from the casing 4, the top edges of the filtering trough 30 are closed above the filtration block 34 in order to be subsequently fastened together and thus to form a jacket around said block. In the example shown in FIGS. 1 to 3, closing and fastening of the top edges of the filtering trough 30 are carried out by means of a device 40 which is somewhat similar to the slider of a zip fastener. This device is placed at the rear end of the casing 4 and is carried by an arm 41 fixed on the hopper 5. The device is constituted by a member having two convergent grooves 42 within which are engaged the beads 21 and 22 of the top edges of the filtering trough 30. The grooves are thus capable of bringing together the top edges of the trough, therefore closing them on top of the filtration block 34, then fixing them in position by simple resilient interengagement in much the same manner as certain types of slide fastener.

There is obtained in this manner a closed filtering jacket which completely surrounds the filtration block 34 as shown in FIG. 5. It will clearly be necessary to add a thin packing layer above the vertical drainage element thus formed in order to complete the filling of the ground channel 27.

As already mentioned, this mode of procedure permits the construction of a vertical drainage element which is just as effective as the prefabricated elements to which reference was made in the introductory part of this specification. The element under consideration is composed of a filtering jacket containing a drainage pipe 15 which is placed at the bottom of the jacket and a vertical filtering block 34 placed above the pipe. However, the method in accordance with the invention and the device employed for carrying out the method have an advantage in that both the construction and installation of this complex drainage element are performed in situ while the channel is being formed in the ground at the same time. They also have the advantage of avoiding any need for extensive earthmoving and backfilling operations. Moreover, the method and the device in accordance with the invention permit highly economical construction of a drainage system of this type.

The method and device under consideration are not limited to the example described in the foregoing since they can be adapted to many other forms of construction. Thus FIGS. 10 to 14 illustrate different alternative embodiments which can be contemplated for fastening the top edges of the filtering trough 30 formed by the strip 14.

In the case of FIG. 10, this fastening operation is ensured by means of the two coupling strips **21*a* and 22*a* which are provided on both edges of the corresponding filtering strip 14*a* and which perform virtually the same function as the beads 21 and 22 described earlier. In fact, one of these coupling strips is adapted to carry press-studs 43 which are intended to be engaged in perforations 44 of the other strip. It is readily apparent that the coupling device 40** is modified accordingly.

With reference to FIG. 11, this figure illustrates another alternative embodiment in which each edge of the corresponding filtering strip **14*b* is rolled-back externally around a rod 45. Coupling of the two corresponding edges in this instance is effected by means of a sectional coupling strip 46 which is fitted in position around the bulges formed by these two edges. Positioning of the sectional coupling strip is carried out by means of a suitable device (not shown in the drawings) which accordingly replaces the coupling device 40**.

FIG. 12 illustrates another alternative embodiment in which the edges of the corresponding filtering strip **14*c* are also rolled-back externally. However, fastening of the edges is effected by inserting staples 47** which are placed in spaced relation to each other. This positioning operation is accordingly carried out by means of a suitable device (not shown in the drawings) which also has the function of drawing the two edges together.

FIG. 13 illustrates a further alternative embodiment in which the edges of the corresponding filtering strip **14*d* are again fastened together by means of staples 48 arranged in spaced relation. In this case, the edges considered are not provided beforehand with a bead or any element of a similar type. In order to fasten them together, these edges are in this case applied against each other and then assembled by means of the staples 48**.

FIG. 14 illustrates yet another alternative embodiment in which the edges of the corresponding filtering strip **14*e* are again not provided with beads or the like. Fastening of these edges is effected in this case by means of a seam 49** formed by a suitable device (not shown).

A point worthy of note in the case of FIGS. 10, 11 and 12 is that the edges of the corresponding filtering strips **14*a*, 14*b* and 14*c* are provided with a bead or the like. In consequence, the device employed for the practical application of the method in accordance with the invention can be the same as in the case of the strip 14 shown in FIG. 10. In fact, retention of the top edges of the trough which are formed by any one of these strips of filtering material can be carried out as before by means of supporting members 20*a* which are capable of constituting guides for supporting the corresponding beads. On the other hand, this is not possible in the case of FIGS. 13 and 14 since the edges of the corresponding filtering strips 14*d* and 14*e*** are not provided with projecting beads or the like.

It is for this reason that a particular embodiment of the device in accordance with the invention is specially intended for this case. In this form of construction, the supports **20*a* forming guides are replaced by members which are capable of retaining the top edges of the filtering trough while this latter is being filled without any need to provide beads or the like on these edges. These supporting members can consist of clamping disks 50 which are rotatably mounted opposite to the internal face of the side walls 26*a* of the corresponding casing 4*a* (as shown in FIG. 16**). The disks are accordingly capable of clamping the top edges of the filtering trough so as to hold them in position while this latter is being filled.

However, any other suitable means could be provided for retaining the edges of the filtering trough during the trough-filling operation when the edges are not provided with beads or other means for readily gripping the edges.

Figure 15:
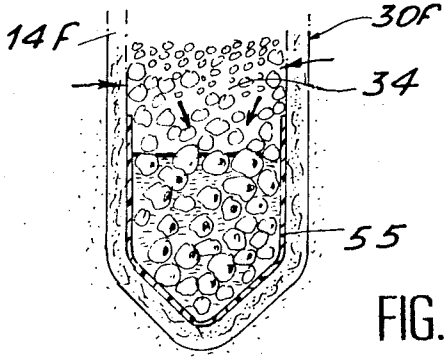
FIG. 15 is a fragmentary sectional view which is similar to FIG. 5 but which corresponds to an alternative embodiment.

As mentioned earlier, the method of drainage in accordance with the invention can be carried into effect without making use of a flexible drainage pipe or hose 15. In such a case (as shown in FIG. 15), the central portion of the filtering strip **14*f* employed is provided with a water-tight lining 55 on at least one of its faces. The width of the water-tight strip thus formed is such that this latter can constitute both the bottom portion of the trough 30*f*** to be subsequently constructed by means of the strip and two leak-tight side portions located on each side of the bottom portion. There is therefore obtained in this manner a gutter which permits collection of filtered water and outflow in the direction of discharge. In consequence, the operation of the drainage system thus formed is the same as before.

However, the strip of filtering material employed for the application of the method in accordance with the invention can also be provided with a water-tight lining over the entire area of one of its two halves so as to form a screen on the corresponding side of the jacket constructed from said strip. This makes it possible to collect runoff water from one side alone while at the same time constituting a water-tight screen on the opposite side, for example next to the roadway or other corresponding area. The result thereby achieved is that runoff water from adjacent land is permitted to flow beneath the roadway or corresponding area.

Figure 17:
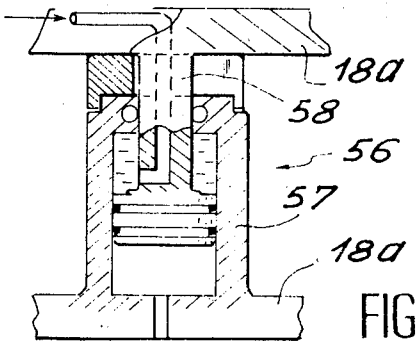
FIG. 17 is a fragmentary horizontal sectional view of an alternative form of construction of the first strip-laying casing, in which the spacing of the casing walls can be modified.

Worthy of mention among the possible variants of the device in accordance with the invention is the embodiment in which arrangements are made to permit use of the device for laying drainage elements having different widths. In this case, at least one of the side walls 18*a* of the corresponding front strip-laying casing 3*a* is mounted so as to be capable of displacement in the transverse direction and is provided with devices for initiating this displacement for the purpose of varying the wall spacing. As illustrated in FIG. 17, these devices can consist of jacks 56 mounted between the two walls 18*a* of the casing 3*a*. Accordingly, the body 57 of each jack aforesaid is rigidly fixed to one of the walls while the rod 58 of each jack piston is rigidly fixed to the other wall. In this case an identical arrangement is provided between the walls of the second casing 4 formed by the lower portion of the discharge hopper 5.

The arrangement thus provided makes it possible to construct drainage elements having different widths according to specific requirements and applications.

As has already been indicated, the method and the device in accordance with the invention are designed for drainage of borders of stabilized civil engineering areas such as roads and highways, airfield runways, railway tracks and the like. However, they may also be employed for drainage of adjacent borders of any building or structure.

Moreover, it should be observed that the invention has for its object not only the method and device described in the foregoing but also the particular element employed in certain forms of construction, namely the strip 14, 14*a*, 14*b* or 14*c* of filtering material, the edges of which are provided with beads or the like for readily retaining the strip edges by means of supporting members 20 and 20*a* forming guides, whether these beads are provided or not provided with coupling means such as those illustrated in FIGS. 10 and 11.

What is claimed is:

1. Apparatus for placing a vertical drainage element within a channel dug in the ground by an excavating machine, comprising (a) a drum for carrying a roll of filtering material;

(b) a casing arranged adjacent the excavating machine for unwinding a continuous strip of filtering material from said drum, said casing including side walls and guide means for directing said strip of filtering material into said channel and for forming said strip into the configuration of a U-shaped trough including a bottom wall and side walls having top edges, said bottom wall being placed at the bottom of the channel and said side walls resting against the channel side walls;

(c) a hopper arranged adjacent said casing, said hopper discharging bulk material in granular form into said trough to define a vertical filtration block therein, said hopper having a lower portion including side walls located in the line of extension of the side walls of the strip-laying casing and at least partially engaging the channel;

(d) said hopper lower portion including means for retaining the top edges of said trough of filter material against the channel walls while bulk material is discharged into said trough; and (e) means arranged adjacent said hopper for closing the top edges of said trough following discharge of said filter material and for fastening said top edges together to define a closed jacket around the filtration block.

2. A device according to claim 1, wherein, in addition to said drum for carrying said roll of filtering material, said device is provided with a second unwinding drum for carrying a roll formed by a drainage pipe and means are provided for causing said pipe to be placed against the portion of strip of filtering material which constitutes the bottom portion of the trough formed by said strip within the channel formed in the ground.

3. A device according to claim 1, wherein the means for retaining the top edges of the trough formed by the strip of filtering material comprise members which are capable of clamping said edges against internal faces of the side walls of the discharge hopper.

4. A device according to claim 1, wherein said discharge hopper includes a system for regulating the top level of the filtration block constructed by filling said trough formed by said strip of filtering material, said system being provided with a movable gate placed behind said hopper and actuated by a control jack.

5. A device according to claim 1, wherein the spacing of said side walls of the strip-laying casing is adjustable as is also the the spacing of the side walls of the lower portion of said discharge hopper, the spacing of said walls being adjustable by means of suitable control devices comprising transverse jacks.

6. A device according to claim 1, wherein said strip of filtering material is provided with beads, the means for retaining the top edges of the trough formed by said strip comprise supports added on internal faces of the side walls of the casing and capable of serving as guides for supporting the beads.

7. A device according to claim 6, wherein said beads which are located on the edges of said strip of filtering material are provided with coupling means involving simple engagement under pressure, and wherein guide means which comprise a coupling device arranged adjacent said hopper are capable of bringing the edges of said strip together and causing engagement of said coupling means.

8. A device according to claim 1, wherein said discharge hopper includes a front end pivotally mounted on said casing and a rear end which bears on a set of wheels.

9. A device according to claim 8, wherein said discharging hopper is coupled to said rear set of wheels by means of a system which permits height adjustment of said hopper and includes a control jack operated in dependence on a unit for receiving suitable reference values.

10. A method of drainage of borders of all stabilized civil engineering areas such as roads and highways, airfield runways, railroad tracks and borders of any building or structure, said method being carried out by placing a vertical drainage element within a trench dug in the ground, said drainage element being constituted by a filtering jacket in which at least one vertical wall is porous and in which the bottom portion of said jacket contains a drainage pipe or outflow gutter, wherein said vertical drainage element is constructed and laid in position while at the same time forming a narrow vertical channel in the ground by means of an excavating machine by performing the following successive operations:

unwinding a strip of filtering material from a rotating roll of strip behind the excavating machine;

introducing said strip within the channel formed in the ground while at the same time shaping said strip in the form of a trough having vertical side walls and top edges, the bottom of the trough being placed at the bottom of the channel while the vertical walls of said trough are placed against corresponding vertical walls of said channel;

while the top edges of the trough thus formed are held in position against the vertical walls of the channel, filling said trough with bulk material in granular form, said bulk material constituting a vertical, filtration block;

closing the top edges of the trough of filtering material on top of the block thus formed and fastening said top edges together so as to form a closed jacket around said block.

11. A method of drainage of borders of all stabilized civil engineering areas such as roads and highways, airfield runways, railroad tracks and borders of any building or structure, said method being carried out by placing a vertical drainage element within a trench dug in the ground, said drainage element being constituted by a filtering jacket in which at least one vertical wall is porous and in which the bottom portion of said jacket contains a drainage pipe or outflow gutter, wherein said vertical drainage element is constructed and laid in position while at the same time forming a narrow vertical channel in the ground by means of an excavating machine by performing the following successive operations:

unwinding a strip of filtering material from a rotating roll of strip behind the excavating machine;

unwinding a drainage pipe simultaneously with the unwinding of said strip;

introducing said strip and said pipe within the channel formed in the ground while at the same time shaping said strip in the form of a trough having vertical side walls and top edges, the bottom of the trough containing said drainage pipe and being placed at the bottom of the channel while the vertical walls of said trough are placed against the corresponding vertical walls of said channel;

while the top edges of the trough thus formed are held in position against the vertical walls of the channel, filling said trough with bulk material in granular form, said bulk material constituting a vertical filtration block;

closing the top edges of the trough of filtering material on top of the block thus formed and fastening said top edges together so as to form a closed jacket around said block.

12. A method of drainage of borders of all stabilized civil engineering areas such as roads and highways, air field runways, railroad tracks and borders of any building or structure, said method being carried out by placing a vertical drainage element within a trench dug in the ground, said drainage element being constituted by a filtering jacket in which at least one vertical wall is porous and in which the bottom portion of said jacket contains a drainage pipe or outflow gutter, wherein said vertical drainage element is constructed and laid in position while at the same time forming a narrow vertical channel in the ground by means of an excavating machine by performing the following successive operations:

providing a fluid-tight lining on at least a portion of a strip of filtering material which is subsequently wound into a roll;

unwinding a strip of said lined filtering material from the rotating roll of strip material behind the excavating machine;

introducing said lined strip within the channel formed in the ground while at the same time shaping said strip in the form of a trough having a aligned bottom and vertical side walls and including top edges, the bottom of the trough being placed at the bottom of the channel while the vertical walls of said trough are placed against the corresponding walls of the channel, said lined bottom and side walls defining a water outflow gutter;

while the top edges of the trough thus formed are held in position against the walls of the channel, filling said trough with bulk material in granular form, said bulk material constituting a vertical filtration block;

closing the top edges of the trough of filtering material on top of the block thus formed and fastening said top edges together so as to form a closed jacket around said block.

* * * * *